US006200538B1

(12) United States Patent
Brück et al.

(10) Patent No.: US 6,200,538 B1
(45) Date of Patent: Mar. 13, 2001

(54) EXHAUST GAS SYSTEM SUITABLE FOR RETROFITTING EXHAUST GAS CATALYTIC CONVERTERS IN MOTORCYCLES

(75) Inventors: Rolf Brück, Bergisch Gladbach; Robert Diewald, Siegburg, both of (DE)

(73) Assignee: Emitec Gesellschaft fuer Emissionstechnologie mbH, Lohmar (DE)

( * ) Notice: Subject to any disclaimer, the term of this patent is extended or adjusted under 35 U.S.C. 154(b) by 0 days.

(21) Appl. No.: 09/096,979

(22) Filed: Jun. 12, 1998

(30) Foreign Application Priority Data

Jun. 12, 1997 (DE) ..... 197 24 964

(51) Int. Cl.[7] ..... B01D 53/34; B01D 53/88; F01N 3/28

(52) U.S. Cl. ..... 422/177; 422/180

(58) Field of Search ..... 422/171, 174, 422/177, 180, 179; 60/299, 300

(56) References Cited

U.S. PATENT DOCUMENTS

| | | | | |
|---|---|---|---|---|
| 3,945,803 | * | 3/1976 | Musall et al. | 422/179 |
| 4,250,146 | * | 2/1981 | Bailey | 422/179 |
| 4,407,785 | * | 10/1983 | Pfefferle | 422/180 |
| 4,909,994 | * | 3/1990 | Nishizawa et al. | 422/180 |
| 5,151,254 | * | 9/1992 | Arai et al. | 422/180 |
| 5,169,604 | * | 12/1992 | Crothers, Jr. | 422/177 |
| 5,413,767 | * | 5/1995 | Breuer et al. | 422/174 |

* cited by examiner

*Primary Examiner*—Hien Tran
(74) *Attorney, Agent, or Firm*—Herbert L. Lerner; Laurence A. Greenberg; Werner H. Stemer

(57) ABSTRACT

The exhaust gas system has an exhaust gas catalytic converter, through which exhaust gases of an internal combustion engine can flow for catalytic conversion of the exhaust gases. The catalytic converter is disposed between two exhaust gas line segments, each forming one line connection with the catalytic converter and each contacting a stop face of the exhaust gas catalytic converter. A bracing element engages at least one of the exhaust gas line segments and braces the catalytic converter between the exhaust gas line segments. The system is particularly suitable for economical retrofitting of exhaust gas catalytic converters in motor cycles.

12 Claims, 2 Drawing Sheets

EXHAUST GAS SYSTEM SUITABLE FOR RETROFITTING EXHAUST GAS CATALYTIC CONVERTERS IN MOTORCYCLES

BACKGROUND OF THE INVENTION

1. Field of the Invention

The invention relates to an exhaust gas system with a catalytic converter through which exhaust gases of an internal combustion engine can flow, for catalytically converting the exhaust gases. The exhaust gas catalytic converter is disposed between two exhaust gas line segments. Each of the exhaust gas line segments forms one line connection with the catalytic converter. The invention relates in particular to motorcycles.

2. Description of the Related Art

German published, non-prosecuted patent application DE 35 43 011 A1 discloses a carrier body for an exhaust gas catalytic converter for converting the exhaust gases of a motor vehicle engine. The carrier body is made up of corrugated and smooth sheet-metal layers that can be coated with a catalyst material. The sheet-metal layers form the walls of a multiplicity of channels through which the exhaust gases can flow inside a tubular housing. German published, non-prosecuted application DE 195 36 853 A1 discloses honeycomb bodies with approximately parallel channels through which the exhaust gases can flow. Among other ways, the honeycomb monoliths may be manufactured by extruding ceramic materials.

An exhaust gas system for an internal combustion engine, in particular an Otto engine of a motor vehicle, is also known from German published, non-prosecuted patent application DE 44 29 878 A1, having an exhaust gas catalytic converter through which exhaust gases of the engine can flow, the exhaust gas catalytic converter being flanged to one exhaust gas line segment on each of its two end faces.

With increasing environmental awareness and ever stricter emissions regulations in many countries of the world, the need has grown to perform catalytic exhaust gas cleaning not only in multi-track motor vehicles but also in motorcycles and in small motors. Small motors are understood here to be motors with a displacement of less than 250 ccm and in particular less than 50 ccm. Such motors are used especially in lawnmowers, edgers, power trimmers, power saws and chain saws, portable generators, small motor bikes, and similar equipment in vehicles. The costs for furnishing an exhaust gas catalytic converter must be in appropriate proportion to the total manufacturing cost for a device or vehicle. Low expense for materials and time is therefore important in retrofitting exhaust gas catalytic converters.

SUMMARY OF THE INVENTION

It is accordingly an object of the invention to provide an exhaust gas system, which overcomes the above-mentioned disadvantages of the prior art devices and methods of this general type and wherein the exhaust gas catalytic converter is integrated into the exhaust gas system in a simple way and in which the exhaust gas system is to be especially suitable for retrofitting exhaust gas catalytic converters in motorcycles.

With the foregoing and other objects in view there is provided, in accordance with the invention, an exhaust gas system, comprising:

an exhaust gas catalytic converter for catalytically cleaning exhaust gases of an internal combustion engine, the catalytic converter having stop faces formed thereon;

two exhaust gas line segments each forming a respective line connection with the catalytic converter on respective sides thereof and contacting the stop faces; and at least one bracing element engaging at least one of the exhaust gas line segments and bracing the catalytic converter between the exhaust gas line segments.

In accordance with an added feature of the invention, the catalytic converter includes a housing, and the at least one bracing element is one of two bracing elements bracing each of the exhaust gas line segments to the catalytic converter housing.

In other words, the catalytic converter is disposed between two exhaust gas line segments, each forming one line connection with the catalytic converter and each contacting a stop face of the exhaust gas catalytic converter. The exhaust gas system has at least one bracing element, which engages at least one of the exhaust gas line segments and with which the exhaust gas catalytic converter is braced by at least one exhaust gas line segments. One advantage of the exhaust gas system of the invention is that the exhaust gas catalytic converter can be integrated into the exhaust gas system at little expense in terms of time and labor.

For instance, the exhaust gas catalytic converter can be retroactively integrated into the exhaust gas system in a simple way by cutting apart the exhaust gas system at a point and inserting the exhaust gas catalytic converter at that point in such a way that the two exhaust gas line segments, separated from one another, come to rest each on one stop face of the exhaust gas catalytic converter. The catalytic converter is then braced between the exhaust gas line segments with at least one bracing element.

In accordance with an added feature of the invention, the bracing element is an element of elastically variable length subjected to a tensile strain, such as, for instance, a helical spring.

With the invention it is possible to use one short bracing element at the transitions from the exhaust gas catalytic converter to each of the two exhaust gas line segments. Short bracing elements enable especially stable fastening.

In accordance with an additional feature of the invention, one or both of the exhaust gas line segments has an eyelet member formed thereon, and the bracing element is connected to the one or both exhaust gas line segments via the eyelet member. The eyelet may for instance be welded to the exhaust gas line segment. Such a connection can be made simply and inexpensively.

In motor vehicles, for instance, adequate stability of the line connections must be assured. For this reason, and also for the sake of ease in manufacture, there is provided in accordance with again a further feature of the invention, a housing of the catalytic converter, in which on at least one end face of the housing, the housing and a portion of the respective exhaust gas line segment are telescoped inside one another along a connecting region extending crosswise to the circumferential direction. The term "circumferential direction" means the circumferential direction of the housing on the respective end face. In one feature, the exhaust gas system has one of the connecting regions on both of the end faces, and the housing is encompassed on both ends by the exhaust gas line segment. In an alternative embodiment, again with one of the connecting regions on each of the two end faces, on one end face, the housing encompasses the exhaust gas line segment, and on the other end face, the exhaust gas line segment encompasses the housing. Preferably, the first end face is located upstream of the exhaust gas catalytic converter. In this way, any narrow gap between the housing and the respective exhaust gas line segment does not experience a direct oncoming flow, so that good sealing of the line connections is attainable.

In accordance with again an added feature of the invention, the housing has a substantially radial protrusion formed thereon, the protrusion defining the stop face. Preferably, the radial protrusion is a circumferential bead formed around the housing. By means of the at least one bracing element it is assured that the exhaust gas line segments will rest on the respective stop face even under conditions of a thermally dictated change in length of the exhaust gas catalytic converter and/or of the exhaust gas line segments. A bead lends strength to the housing and can be made quickly, for instance with the aid of a pressing tool.

In accordance with a concomitant feature of the invention, the exhaust gas catalytic converter has a reaction region with catalytically active material, the reaction region having a length of less than 15 cm extending in a flow direction. The length of the reaction region, in the preferred embodiment, has a length of approximately 10 cm.

Particularly in retrofitting an exhaust gas catalytic converter, there is often little space available for the exhaust gas catalytic converter. For this reason, it is proposed that the length of the exhaust gas catalytic converter be selected to be as short as possible, most suitably less than 15 cm, and preferably about 10 cm.

Other features which are considered as characteristic for the invention are set forth in the appended claims.

Although the invention is illustrated and described herein as embodied in an exhaust gas system suitable for retrofitting exhaust gas catalytic converters in motorcycles, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
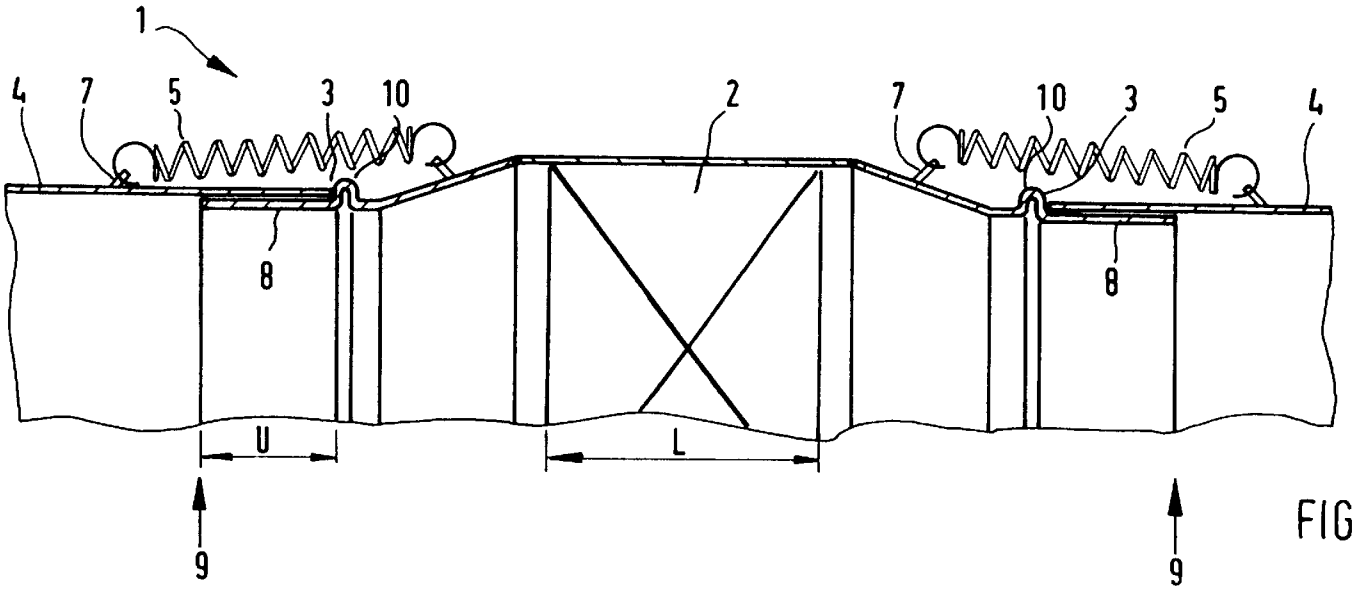
FIG. 1 is a partial longitudinal sectional view through a first embodiment of the exhaust gas system of the invention.

Referring now to the figures of the drawing in detail and first, particularly, to FIG. 1 thereof, there is seen an exhaust gas system 1 with a catalytic converter 2 for catalytically converting exhaust gases of an internal combustion engine. A respective exhaust gas line segment 4 is connected to each of the two end faces 9 of the catalytic converter 2. A jacket tube 8 of the exhaust gas catalytic converter 2 and one portion of each exhaust gas line segment 4 extend one inside the other along a connecting region U extending in the flow direction. The exhaust gas line segment 4 encompasses the jacket tube 8 on both end faces 9, thus forming a line connection that is sealed off against the passage of gas through it. The exhaust gas line segments 4 with their ends each meet a respective stop face 3 of an external bead 10 of the jacket tube 8, the bead extending in the circumferential direction.

Behind the external bead 10, as viewed from the end faces 9, the jacket tube widens conically towards the central region of the exhaust gas catalytic converter 2. The catalytic converter 2 includes a (diagrammatically indicated) honeycomb body which extends over the length L. The honeycomb body is coated with a catalytically active coating. The honeycomb body comprises stacked and intertwined layers of sheet metal, which carry the catalytically effective material. In an alternative embodiment, the honeycomb body is a monolith produced from a ceramic material by extrusion with subsequent firing. The length L is approximately 10 cm.

The eyelets 7 are welded both to the outer circumference of the exhaust gas line segments 4 and to the conical regions of the jacket tube 8. One end of a helical spring 5 is suspended from each of the eyelets 7. The helical springs 5 are subject to tensile strain, so that the housing 8 is braced to the exhaust gas line segments 4.

Figure 2:
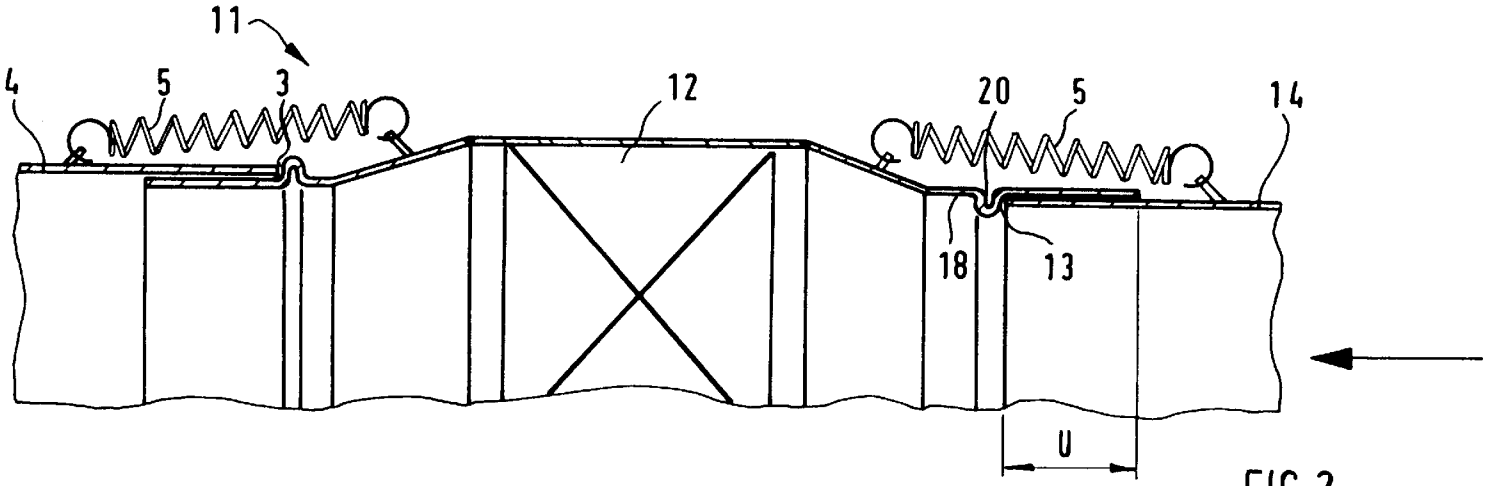
FIG. 2 is a similar view of an alternative embodiment of the invention.

The exhaust gas system 11 shown in FIG. 2 differs from the exhaust gas system 1 (shown in FIG. 1) in terms of the connection between the jacket tube 18 of the exhaust gas catalytic converter and the exhaust gas line segment 14 shown on the right-hand side of FIG. 2. The jacket tube 18 has an internal bead 20, whose stop face 13 is struck by the end of the exhaust gas line segment 14, where the exhaust gas line segment 14 comes to rest. As shown in FIG. 2, exhaust gas line segment 14 is located upstream of exhaust gas line segment 4. The jacket tube 18 encompasses the end portion of the exhaust gas line segment 14. As indicated by an arrow, the line connection having internal bead 20 is located between the exhaust gas line segment 14 and the jacket tube 18. The jacket tube 18 is located on the side 18, where the gas enters the exhaust gas catalytic converter 12. Any slight leaks between the jacket tube 18 and the exhaust gas line segment 14, or the exhaust gas line segment 4, are negligible during the operation of the exhaust gas system 11, because the flow of exhaust gas is carried past the leaking points.

Figure 3:
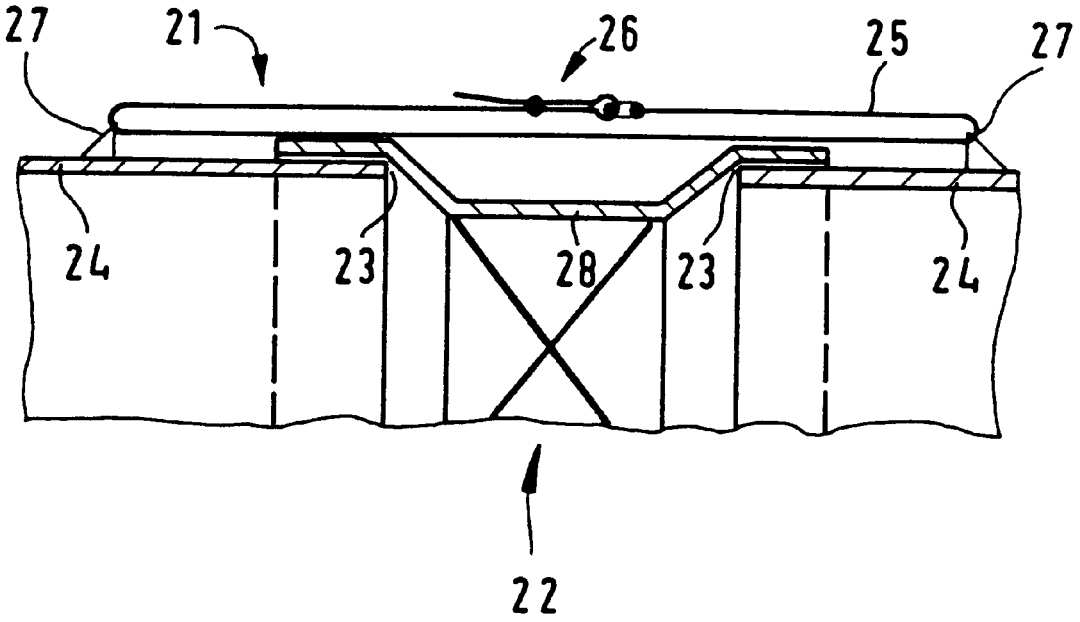
FIG. 3 is a partial longitudinal sectional view through a further embodiment of the invention.

With reference to FIG. 3, the exhaust gas system 21 has a catalytic converter 22 whose jacket tube 28 has a smaller cross-sectional area in the middle than the exhaust gas line segments 24 to which the exhaust gas catalytic converter 22 is connected. The ends of each of the exhaust gas line segments 24 strike a respective stop face 23 of a conical portion of the jacket tube 28. The exhaust gas catalytic converter 22 is braced with two tension bands 25 between the exhaust gas line segments 24. Because FIG. 3 is a fragmentary view, only one of the tension bands 25 can be seen there. The tension band 25 is connected to the exhaust gas line segments 24 each via a respective retaining bracket 27. It is at least partly made of an elastic material. By means of the closure 26, it is possible to establish a certain predetermined tension.

In the exhaust gas system of the invention, an exhaust gas catalytic converter is integrated in a simple way. In particular, it is possible to install the exhaust gas catalytic converter retroactively into the exhaust gas system by inserting it and then bracing it between two exhaust gas line segments.

Because of the low costs of such retrofitting, the exhaust gas system can be used in many existing kinds of equipment and vehicles driven by internal combustion engines.

We claim:

1. In a catalytic converter for connection to an exhaust gas line segment having an exhaust gas line segment end with an exhaust gas line segment circumference, the improvement comprising:

a housing including a housing end, one of said ends of said housing and of the exhaust gas line segment overlapping the other, said housing end including a stop face, said stop face having a circumference equal to the exhaust gas line segment circumference, said stop face and the exhaust gas line segment abutting to form a line connection; and a bracing element engaging the exhaust gas line segment and said housing.

2. The improvement according to claim 1, wherein said bracing element is an element of elastically variable length subjected to a tensile strain.

3. The improvement according to claim 1, wherein said bracing element is a helical spring.

4. The improvement according to claim 1, wherein said exhaust gas line segment has an eyelet member formed thereon, and said bracing element is connected to said eyelet member.

5. The improvement according to claim 1, wherein said housing end and said exhaust gas line segment end telescope inside one another along a connecting region extending transversely to a circumferential direction about said housing.

6. The improvement according to claim 5, further comprising:

two exhaust gas line segments, two of said housing ends, wherein:

each of said two housing ends connects to a respective one of said two exhaust gas line segments.

7. The improvement according to claim 6, further comprising:

an equal number of bracing elements as the number of exhaust gas line segments, each of said bracing elements bracing one of said exhaust gas line segments to said housing.

8. The improvement according to claim 5, wherein said housing has two housing ends respectively each connected to one of said exhaust gas line segment ends, wherein:

one of said housing ends encompasses the respective exhaust gas line segment end, and another of said housing ends is encompassed by the respective exhaust gas line segment end.

9. The improvement according to claim 1, wherein said housing has a substantially radial protrusion formed thereon, said protrusion defining said stop face.

10. The improvement according to claim 9, wherein said radial protrusion is a circumferential bead formed around said housing.

11. The improvement according to claim 1, further comprising:

a reaction region with catalytically active material contained in said housing, said reaction region having a length of less than 15 cm extending in a flow direction.

12. The improvement according to claim 11, wherein said length of said reaction region is approximately 10 cm.

* * * * *